US006923195B2

(12) United States Patent
Tseng

(10) Patent No.: US 6,923,195 B2
(45) Date of Patent: Aug. 2, 2005

(54) SKELETON FRAME ASSEMBLY FOR A TENT

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 149 days.

(21) Appl. No.: 10/619,869

(22) Filed: Jul. 15, 2003

(65) Prior Publication Data

US 2005/0011156 A1 Jan. 20, 2005

(51) Int. Cl.[7] ..... E04H 15/34; E04H 15/44

(52) U.S. Cl. ..... 135/122; 135/87; 135/159; 135/160; 52/79.6; D25/56; D25/100; D25/132

(58) Field of Search ..... 135/87, 122, 158–160; 52/79.6, 311.3, 653.1, 653.2, 663; D25/26, 56, 100, 132

(56) References Cited

U.S. PATENT DOCUMENTS 1,924,880 A * 8/1933 Ragsdale ..... 52/650.2
2,857,027 A * 10/1958 Lindman ..... 52/690
3,608,951 A * 9/1971 Jackson ..... 296/162
3,998,025 A * 12/1976 Nestroy ..... 52/632
6,745,521 B1 * 6/2004 Klemming ..... 52/79.6
6,820,629 B2 * 11/2004 Tseng ..... 135/152
D501,259 S * 1/2005 Wang ..... D25/56
2004/0111984 A1 * 6/2004 Klemming ..... 52/79.6

* cited by examiner

*Primary Examiner*—Robert Canfield
(74) *Attorney, Agent, or Firm*—Ladas & Parry LLP

(57) ABSTRACT

A tent skeleton frame assembly includes vertical poles, each of which defines a first side and a second side transverse to the first side, and includes a first vertical rod, a second vertical rod spaced apart from and aligned with the first vertical rod along the first side of a respective one of the vertical poles, a third vertical rod spaced apart from and aligned with the second vertical rod along the second side of the respective one of the vertical poles, and three elongated latticed plates. Each vertical rod is formed with two engaging grooves. Each latticed plate has opposite sides respectively engaging an adjacent pair of the engaging grooves in an adjacent pair of the vertical rods.

6 Claims, 5 Drawing Sheets

SKELETON FRAME ASSEMBLY FOR A TENT

BACKGROUND OF THE INVENTION

1. Field of the Invention

The present invention relates to a tent, more particularly to a skeleton frame assembly for a tent.

2. Description of the Related Art

A conventional tent assembly includes a skeleton frame which comprises a plurality of spaced apart vertical poles cooperatively defining a shelter space thereamong, a plurality of tie beams, each of which is disposed between an adjacent pair of the vertical poles and each of which has two opposite ends respectively secured to top ends of the adjacent pair of the vertical poles, and a roof frame disposed above the tie beams and the top ends of the vertical poles. A flysheet can be spread over the top frame for shielding purposes.

The conventional tent assembly is disadvantageous in that the skeleton frame cannot withstand strong winds and that the vertical poles and the tie beams have a monotonous appearance.

SUMMARY OF THE INVENTION

Therefore, the object of this invention is to provide a skeleton frame assembly for a tent, which is capable of overcoming the aforesaid drawbacks of the prior art.

According to the present invention, a skeleton frame assembly for a tent includes: at least three spaced apart vertical poles cooperatively defining a shelter space thereamong, each of the vertical poles defining a first side and a second side transverse to the first side, and having opposite upper and lower ends, each of the vertical poles including a first vertical rod, a second vertical rod spaced apart from and aligned with the first vertical rod along the first side of a respective one of the vertical poles, a third vertical rod spaced apart from and aligned with the second vertical rod along the second side of the respective one of the vertical poles, and three elongated latticed plates, each of which interconnects an adjacent pair of the first, second and third vertical rods, each of the first, second and third vertical rods having a non-circular cross-section and being formed with two engaging grooves extending along a longitudinal length thereof, each of the latticed plates having opposite sides respectively engaging an adjacent pair of the engaging grooves in the adjacent pair of the first, second and third vertical rods; at least three pole couplers mounted respectively on the upper ends of the vertical poles; at least three horizontal tie beam units, each of which has two opposite ends connected respectively to an adjacent pair of the pole couplers so as to provide stability and rigidity to the skeleton frame assembly; and a roof frame disposed over the pole couplers and the tie beam units above the shelter space.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
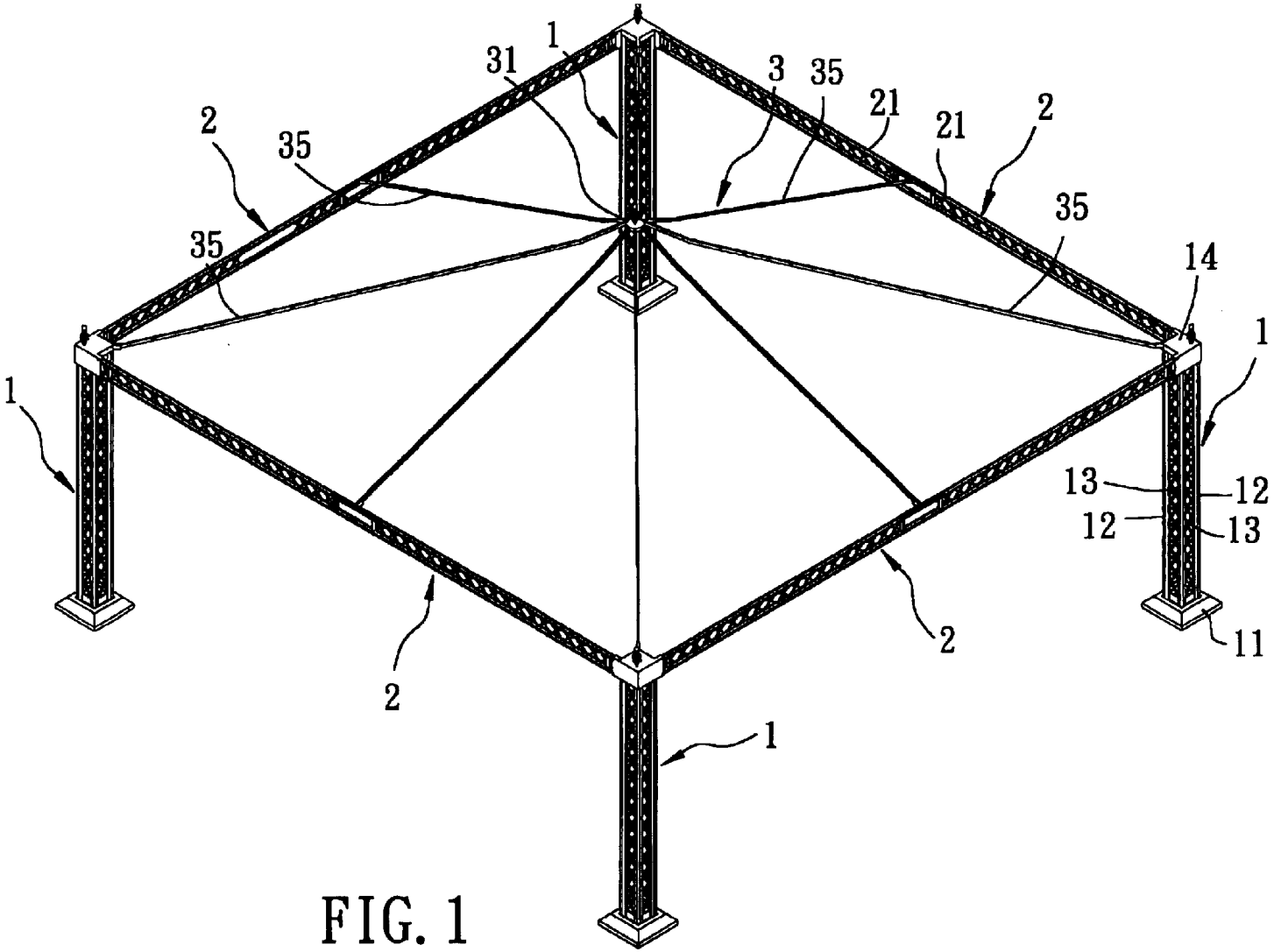
FIG. 1 is a perspective view of the preferred embodiment of a skeleton frame assembly for a tent according to the present invention.
Figure 2:
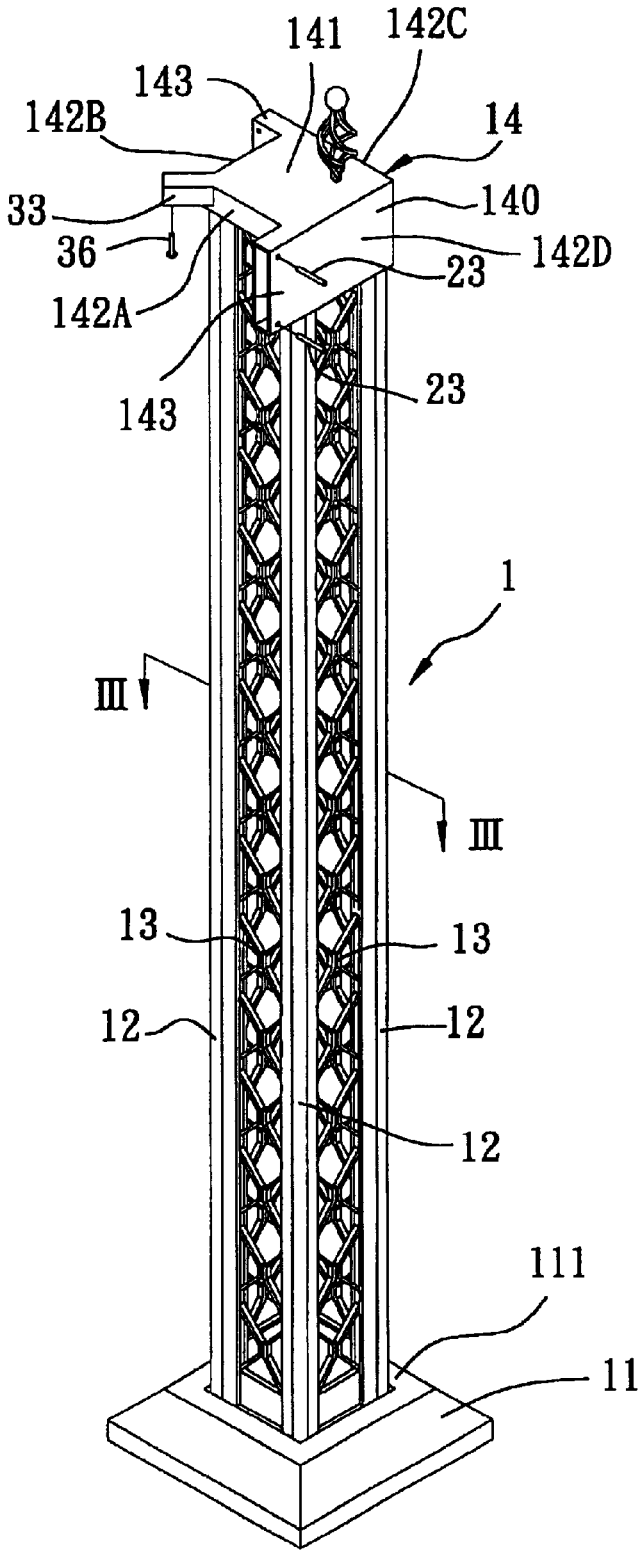
FIG. 2 is a perspective view of a vertical pole and a pole coupler of the preferred embodiment.
Figure 3:
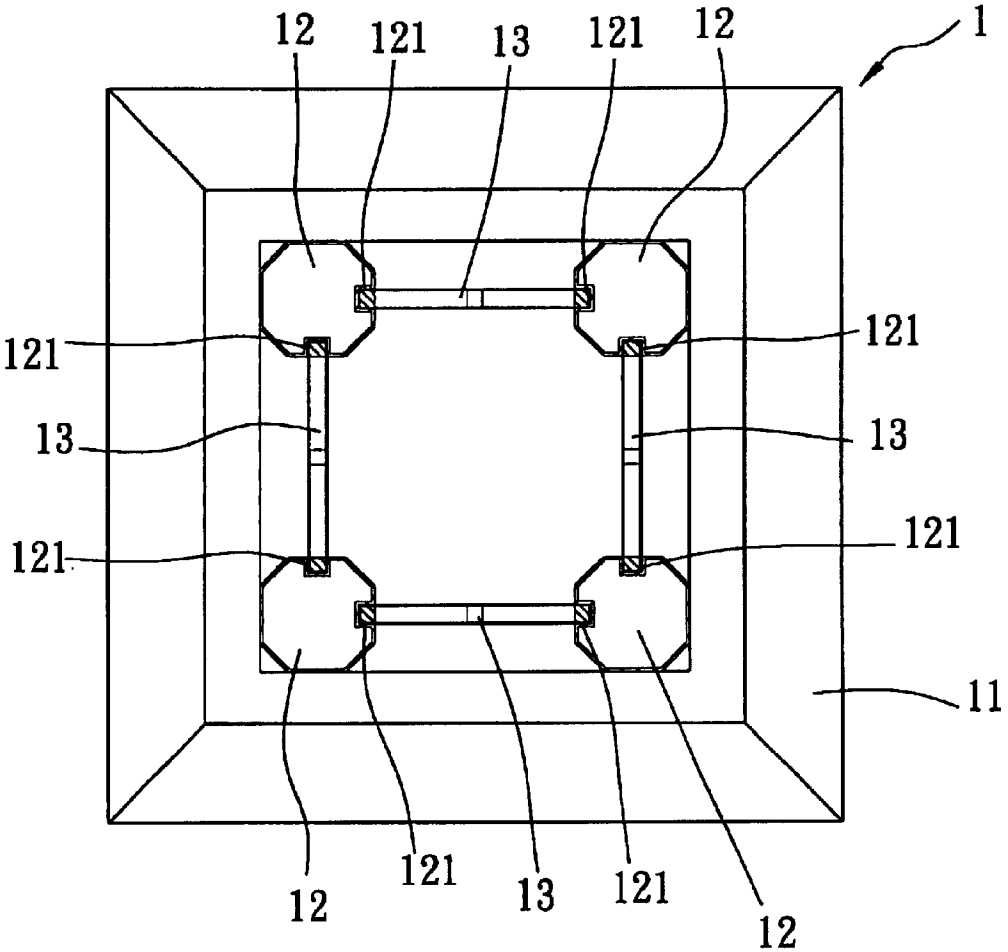
FIG. 3 is a partly sectional view of the vertical pole taken along lines III—III in FIG. 2.
Figure 4:
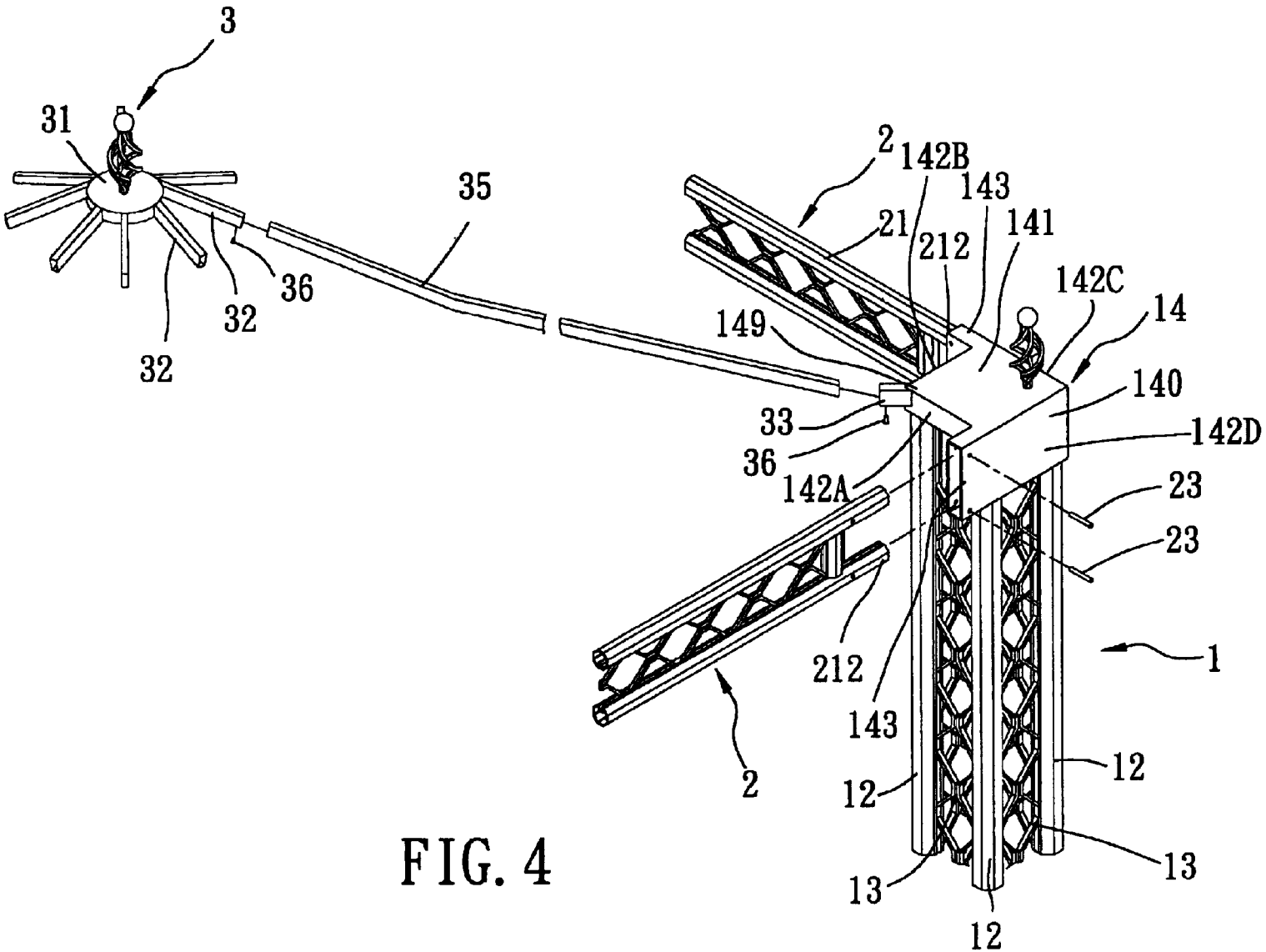
FIG. 4 is a fragmentary exploded perspective view of the preferred embodiment, illustrating the structural relationship among the vertical poles, tie-beam units, and a roof frame.

Referring to FIGS. 1 to 4, the preferred embodiment of a skeleton frame assembly for a tent according to the present invention is shown to include four spaced apart vertical poles 1, four pole couplers 14, four horizontal tie beam units 2, and a roof frame 3.

As illustrated, the four vertical poles 1 are adapted to be seated on a supporting surface, and cooperatively define a shelter space thereamong. Each of the vertical poles 1 defines a first side, a second side transverse to the first side, a third side opposite to the first side and transverse to the second side, and a fourth side opposite to the second side and transverse to the third side. Each of the vertical poles 1 has opposite upper and lower ends, and includes a first vertical rod 12, a second vertical rod 12 spaced apart from and aligned with the first vertical rod 12 along the first side of a respective one of the vertical poles 1, a third vertical rod 12 spaced apart from and aligned with the second vertical rod 12 along the second side of the respective one of the vertical poles 1, and a fourth vertical rod 12 spaced apart from and aligned with the third vertical rod 12 along the third side of the respective one of the vertical poles 1. Each of the vertical poles 1 further includes four elongated latticed plates 13, each of which interconnects an adjacent pair of the first, second, third and fourth vertical rods 12. In this preferred embodiment, each of the first, second, third and fourth vertical rods 12 is made from aluminum alloy, has an octagonal cross-section, and is formed with two engaging grooves 121 extending along a longitudinal length thereof. Each of the latticed plates 13 has opposite sides respectively engaging an adjacent pair of the engaging grooves 121 in the adjacent pair of the vertical rods 12.

The pole couplers 14 are mounted securely and respectively on the upper ends of the vertical poles 1.

Each of the tie beam units 2 has two opposite ends 212 connected respectively to an adjacent pair of the pole couplers 14 so as to provide stability and rigidity to the skeleton frame assembly.

The roof frame 3 is disposed over the pole couplers 14 and the tie beam units 2 above the shelter space. A flysheet (not shown) can be spread over the roof frame 3 for shielding purposes.

Each of the first, second, third and fourth vertical rods 12 has opposite upper and lower ends. The upper ends of the first, second, third and fourth vertical rods 12 cooperatively define the upper end of a respective one of the vertical poles 1. The lower ends of the first, second, third and fourth vertical rods 12 cooperatively define the lower end of the respective one of the vertical poles 1. The preferred embodiment further includes four footings 11, which are adapted to be seated on the supporting surface, and each of which is formed with a rectangular slot 111 (see FIG. 2) that receives fittingly the lower ends of the vertical rods 12 of a respective one of the vertical poles 1.

Each of the pole couplers 14 has a top wall 141 disposed above the upper end of a respective one of the vertical poles 1, and a peripheral wall 140 extending downwardly from the top wall 141 to enclose the upper ends of the vertical rods 12 of a respective one of the vertical poles 1. The peripheral wall 140 of each of the pole couplers 14 includes a first side wall 142A that faces the first side of a respective one of the vertical poles 1 and that is formed with a first tubular member 143 projecting outwardly therefrom, a second side wall 142B that faces the second side of the respective one of the vertical poles 1 and that is formed with a second tubular member 143 projecting outwardly therefrom, a third side wall 142C that faces the third side of the respective one of the vertical poles 1, and a fourth side wall 142D that faces the fourth side of the respective one of the vertical poles 1. The opposite ends of each of the tie beam units 2 extend into and are secured to an adjacent pair of the first and second tubular members 143 of the adjacent pair of the pole couplers 14 through a plurality of fastener screws 23 (see FIGS. 2 and 4).

The first and second side walls 142A, 142B of each of the pole couplers 14 cooperatively define a corner 149 (see FIG. 4) therebetween. Each of the pole couplers 14 is further formed with a third tubular member 33 projecting outwardly from the corner 149 into the shelter space.

Figure 5:
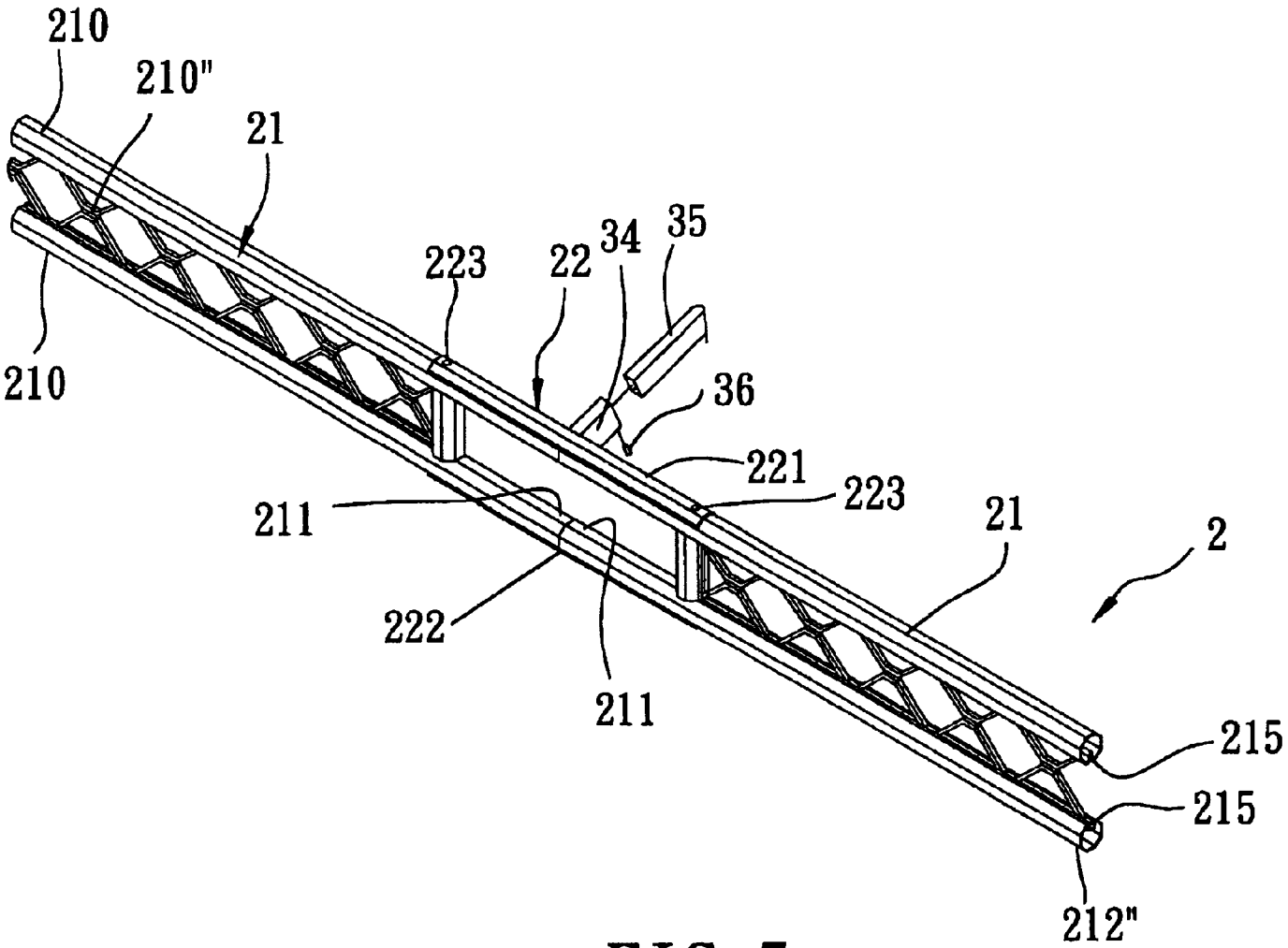
FIG. 5 is a fragmentary perspective view of a tie beam unit of the preferred embodiment.

Referring to FIG. 5, each of the tie beam units 2 preferably includes left and right parts 21, and an interconnecting unit 22 interconnecting the left and right parts 21. Each of the left and right parts 21 includes upper and lower tie beams 210, each of which has opposite inner and outer ends 211,212" and an engaging groove 215 extending between the inner and outer ends 211,212" thereof, and a webbed plate 210" extending between the upper and lower tie beams 210 and inserted into the engaging grooves 215 in the upper and lower tie beams 210. When the left and right parts 21 are interconnected by the interconnecting unit 22, the inner ends 211 of the upper and lower tie beams 210 of the left part 21 respectively abut against the inner ends 211 of the upper and lower tie beams 210 of the right part 21, while the outer ends 212" of the upper and lower tie beams 210 of each of the left and right parts 21 cooperatively define a respective one of the opposite ends 212 of a respective one of the tie beam units 2 and engage a respective one of an adjacent pair of the first and second tubular members 143 of the adjacent pair of the pole couplers 14. Alternatively, hinges (not shown) may be used to interconnect, pivotally the inner ends 211 of the upper and lower tie beams 210 of the left and right parts 21 so as to facilitate storage. The interconnecting unit 22 includes an upper interconnecting plate 221 that is disposed to overlap the inner ends 211 of an adjacent pair of the upper tie beams 210 of the left and right parts 21, a lower interconnecting plate 222 that is disposed to overlap the inner ends 211 of an adjacent pair of the lower tie beams 210 of the left and right parts 21, and a plurality of adjustable bolts 223 which extend through the upper and lower interconnecting plates 221,222 and which engage the inner ends 211 of the upper and lower tie beams 210 of the left and right parts 21. The upper interconnecting plate 221 of the interconnecting unit 22 of each of the tie beam units 2 is formed with a fourth tubular member 34 projecting outwardly therefrom into the shelter space.

The roof frame 3 includes an apex portion 31 and a plurality of rafters 35. The apex portion 31 is formed with a plurality of rafter-holding tubular member 32*s* extending outwardly therefrom. Each of the rafters 35 has two opposite ends which are inserted respectively into a respective one of the rafter-holding tubular members 32, and one of the third tubular member 33 of a respective one of the pole couplers 14 and the fourth tubular member 34 of the upper interconnecting plate 221 of the interconnecting unit 22 of a respective one of the tie beam units 2, and which are secured therein through fastener screws 36.

With the configuration of the vertical poles 1 and the tie beam units 2 in the skeleton frame assembly of this invention, the aforesaid disadvantages of the prior art can thus be eliminated.

With this invention thus explained, it is apparent that numerous modifications and variations can be made without departing from the scope and spirit of this invention. It is therefore intended that the invention be limited only as indicated in the appended claims.

I claim:

1. A skeleton frame assembly for a tent, comprising: at least three spaced apart vertical poles cooperatively defining a shelter space thereamong, each of said vertical poles defining a first side and a second side transverse to said first side, and having opposite upper and lower ends, each of said vertical poles including at least three vertical rods comprising; a first vertical rod, a second vertical rod spaced apart from and aligned with said first vertical rod along said first side of a respective one of said vertical poles, a third vertical rod spaced apart from and aligned with said second vertical rod along said second side of the respective one of said vertical poles, and at least three elongated latticed plates, each of which interconnects an adjacent pair of said vertical rods, each of said vertical rods having a non-circular cross-section and being formed with two engaging grooves extending along a longitudinal length thereof, each of said latticed plates having opposite sides respectively engaging an adjacent pair of said engaging grooves in said adjacent pair of said vertical rods; at least three pole couplers mounted respectively on said upper ends of said vertical poles; at least three horizontal tie beam units, each of which has two opposite ends connected respectively to an adjacent pair of said pole couplers so as to provide stability and rigidity to said skeleton frame assembly; and a roof frame disposed over said pole couplers and said tie beam units above said shelter space.

2. The skeleton frame assembly as defined in claim 1, wherein each of said vertical rods has opposite upper and lower ends, said upper ends of said vertical rods cooperatively defining said upper end of a respective one of said vertical poles, said lower ends of said vertical rods cooperatively defining said lower end of the respective one of said vertical poles, said skeleton frame assembly further comprising three footings, which are adapted to be seated on a supporting surface, and each of which is formed with a slot that fittingly receives said lower ends of said vertical rods of a respective one of said vertical poles.

3. The skeleton frame assembly as defined in claim 2, wherein each of said pole couplers has a top wall disposed above said upper end of a respective one of said vertical poles, a first side wall that extends downwardly from said top wall, that faces said first side of a respective one of said vertical poles, and that is formed with a first tubular member projecting outwardly therefrom, and a second side wall that extends downwardly from said top wall, that faces said second side of the respective one of said vertical poles, and that is formed with a second tubular member projecting outwardly therefrom, said opposite ends of each of said tie beam units extending into and secured to an adjacent pair of said first and second tubular members of said adjacent pair of said pole couplers, respectively.

4. The skeleton frame assembly as defined in claim 3, wherein said first and second side walls of each of said pole couplers cooperatively define a corner therebetween, each of said pole couplers being further formed with a third tubular member projecting outwardly from said corner into said shelter space.

5. The skeleton frame assembly as defined in claim 4, wherein each of said tie beam units includes left and right parts and an interconnecting unit interconnecting said left and right parts, each of said left and right parts including upper and lower tie beams each of which has opposite inner and outer ends and an engaging groove extending between said inner and outer ends thereof, and a webbed plate extending between said upper and lower tie beams and inserted into said engaging grooves in said upper and lower tie beams, said inner ends of said upper and lower tie beams of said left part of a respective one of said tie beam units respectively abutting against said inner ends of said upper and lower tie beams of said right part of the respective one of said tie beam units, said outer ends of said upper and lower tie beams of each of said left and right parts cooperatively defining a respective one of said opposite ends of a respective one of said tie beam units and engaging a respective one of an adjacent pair of said first and second tubular members of said adjacent pair of said pole couplers, said interconnecting unit including an upper interconnecting plate overlapping said inner ends of an adjacent pair of said upper tie beams of said left and right parts, a lower interconnecting plate overlapping said inner ends of an adjacent pair of said lower tie beams of said left and right parts, and a plurality of adjustable bolts extending through said upper and lower interconnecting plates and engaging said inner ends of said upper and lower tie beams of said left and right parts.

6. The skeleton frame assembly as defined in claim 5, wherein said upper interconnecting plate of said interconnecting unit of each of said tie beam units is formed with a fourth tubular member projecting outwardly therefrom into said shelter space, said roof frame including an apex portion formed with a plurality of rafter-holding tubular members extending outwardly therefrom, and a plurality of rafters, each of which has two opposite ends inserted respectively into a respective one of said rafter-holding tubular members of said apex portion and one of a respective one of said third tubular members of said pole couplers and said fourth tubular member of said upper interconnecting plate of said interconnecting unit of a respective one of said tie beam units.

* * * * *